United States Patent [19]

Buckley et al.

[11] 4,219,283

[45] Aug. 26, 1980

[54] CONTAINER HAVING AN INTERIORLY TELESCOPING DISPENSING MEMBER

[76] Inventors: Michael A. Buckley, 816 Jersey Ave., Normal, Ill. 61761; David F. Friedman, 610 W. Seminary, Bloomington, Ill. 61701

[21] Appl. No.: 897,039

[22] Filed: Apr. 17, 1978

[51] Int. Cl.[2] ..... A46B 11/00

[52] U.S. Cl. ..... 401/129; 30/324; 128/269

[58] Field of Search ..... 222/191, 356; 206/219, 206/220; 30/324, 325, 326, 327, 328; 215/DIG. 5; 128/222, 269; 141/23, 108, 109, 112; 401/119, 126, 127, 128, 129, 191

[56] References Cited

U.S. PATENT DOCUMENTS

| | | | |
|---|---|---|---|
| 363,983 | 5/1887 | Brooks | 401/127 |
| 790,582 | 5/1905 | Low | 401/127 |
| 1,108,767 | 8/1914 | Lechner | 30/328 |
| 1,215,823 | 2/1917 | Lewis | 128/222 |
| 2,485,303 | 10/1949 | Marcus | 128/222 X |
| 2,520,605 | 8/1950 | Maynier | 128/269 X |
| 2,538,447 | 1/1951 | Finney | 401/127 |

*Primary Examiner*—Robert J. Spar
*Assistant Examiner*—Fred A. Silverberg
*Attorney, Agent, or Firm*—Fitch, Even & Tabin

[57] ABSTRACT

A removable closure for a hollow container carries a member for dispensing the contents of the container and the member is mounted on the closure for movement between a retracted position within the container when the closure is secured on the container and an extended position in which the member may contact substantially all parts of the interior of the container when the closure is removed from the container.

1 Claim, 7 Drawing Figures

CONTAINER HAVING AN INTERIORLY TELESCOPING DISPENSING MEMBER

The present invention relates generally to containers and more particularly to containers with closures carrying members such as spoons for dispensing the contents of the containers.

The primary object of the invention is to mount a dispensing member on a closure in a novel manner enabling the member to be enclosed within the container when the closure is secured in a closed position on the container and to reach substantially all portions of the interior of the container when the closure is removed from the container.

Another object is to achieve the foregoing object by mounting the dispensing member on the closure for movement between a retracted position spaced from a top end wall of the closure a distance no greater than the depth of the container and an extended position spaced from the closure end wall a distance greater than the depth of the container.

A more detailed object is to mount the dispensing member on the closure through the medium of two elongated telescoping parts one of which is secured to the closure and the other of which carries the dispensing member.

Other objects and advantages of the invention will become apparent from the following detailed description taken in conjunction with the drawings in which.

Figure 1:
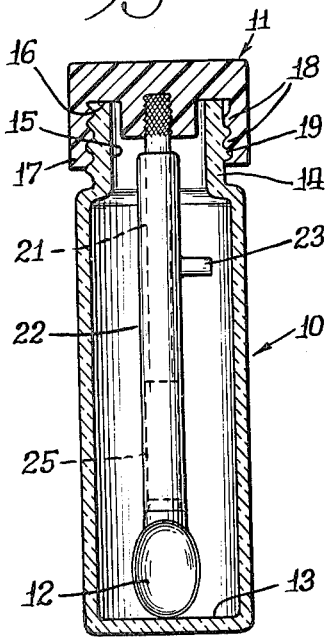
FIG. 1 is a vertical sectional view of a container and closure with dispensing member embodying the novel features of the present invention.
Figure 2:
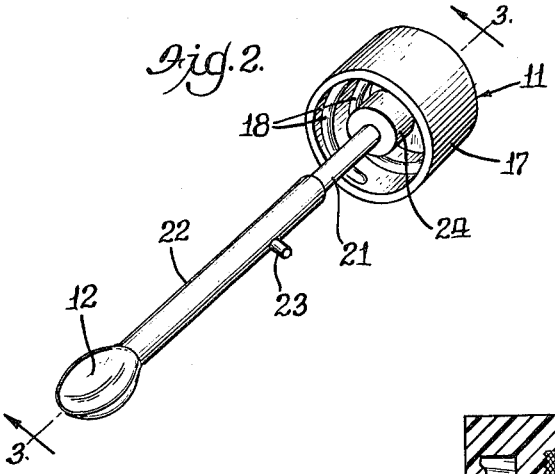
FIG. 2 is a perspective view of the closure and dispensing member with the latter in a partially extended position.

The invention is shown in the drawings for purposes of illustration embodied in a container 10 with a closure 11 which carries a dispensing member 12. The container may be formed of glass as shown or of some other material such as a molded plastic. Herein the container is cylindrical with a bottom wall 13 and neck portion 14 having a top with an opening 15 through which contents of the container may be inserted or withdrawn.

The closure 11 is generally of inverted cup shape with a flat end wall 16 and a depending skirt 17 adapted to encircle the neck portion 14 of the container. Locking elements 18 and 19 on the skirt and the outer side of the neck portion are interengageable to secure the closure removably in a closed position in which its end wall engages the top of the container as shown in FIG. 1. In the present instance, the closure is formed of a molded plastic material and the locking elements 18 and 19 are mating threads.

Figure 6:
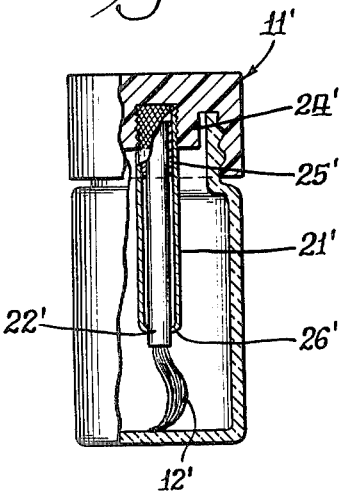
FIG. 6 is a view partially in section similar to FIG. 1 showing the modified construction.
Figure 7:
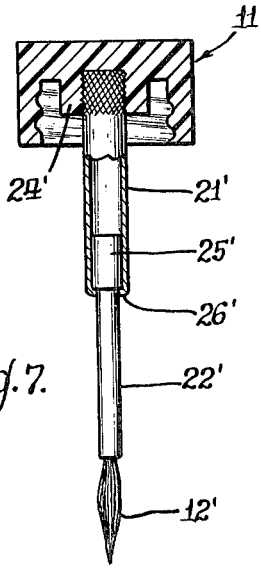
FIG. 7 is a view of the modified construction similar to FIG. 4.

The dispensing member 12 may take various forms depending on the nature of the contents of the container to be dispensed. For example, in the case of granular or powdered material, the dispensing member may be a spoon of predetermined size as shown in FIGS. 1 to 4 to dispense measured quantities of the contents. Or, as shown in FIGS. 6 and 7 where parts corresponding to parts in FIGS. 1 to 5 bear similar but primed reference characters, the dispensing member 12' may be a brush for use with a liquid such as finger nail polish.

In accordance with the present invention, the dispensing member 12 is mounted in a novel manner on the closure 11 to facilitate removal of the entire contents of the container using the dispensing member. To this end, the member is supported on the closure for movement from a retracted position with its outer end spaced from the closure end wall 16 a distance no greater than the depth of the container when the closure is in its closed position as shown in FIG. 1 and an extended position shown in FIG. 4 in which the outer end of the member is spaced from the closure end wall a distance greater than the depth of the container, such depth being the predetermined distance between the bottom wall 13 of the container and the top of its neck portion 14. When the closure is removed from the container and the dispensing member is in its extended position, the member may be moved to engage substantially all parts of the interior of the container including the corner at the intersection of the bottom wall and the side wall of the container thereby facilitating removal of all of the contents of the container.

While the mounting means supporting the dispensing member 12 on the closure 11 for movement between its retracted and extended positions may take various forms, preferably, it comprises two elongated parts 21 and 22 the upper one of which is secured to and projects from the closure along its axis and the other one of which telescopes with the upper part and, at its lower end, carries the dispensing member. To facilitate movement of the lower part relative to the upper without grasping the dispensing member or the lower part, a lug 23 is secured to and projects outwardly from the lower part at a point spaced from the dispensing member. The construction is simplified and slotting of the upper part is avoided by forming the lower part as a tube which telescopes over the upper part as shown in FIGS. 1 to 5.

Figure 4:
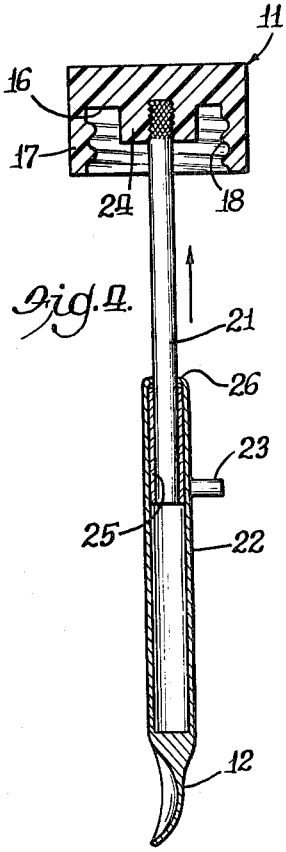
FIG. 4 is a view similar to FIG. 3 but showing the dispensing member in its fully extended position.

In the preferred embodiment of FIGS. 1 to 5, the upper telescoping part 21 is shown as a solid cylindrical rod having its upper end secured rigidly in a boss 24 formed integral with and extending inwardly from the end wall 16 of the closure 11. The lower part 22 is a cylindrical tube having its inner diameter slightly larger than the outer diameter of the rod. To provide a bearing guiding the lower part in its sliding vertical movement relative to the upper part and to prevent wobble of the lower part, a cylindrical sleeve 25 is secured to the lower end portion of the upper part and slidably receives the upper end portion of the lower part. Downward movement of the lower part is limited by engagement of a shoulder 26 turned in at its upper end with the upper end of the sleeve as shown in FIG. 4. The spoon 12 in this instance is formed separately from and secured to the lower end of the tubular lower telescoping part 22. Upward movement of the lower part is limited by engagement of the lower end of the sleeve with the upper end of the spoon.

Figure 3:
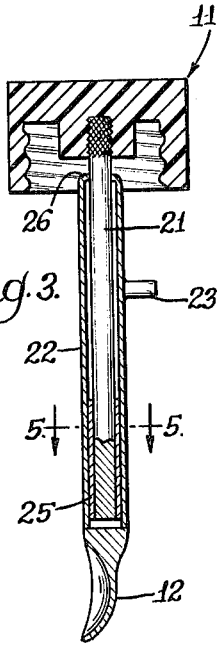
FIG. 3 is a sectional view taken along the line 3—3 of FIG. 2 but showing the dispensing member in the same retracted position shown in FIG. 1.
Figure 5:
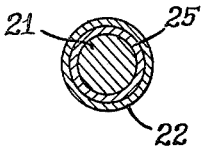
FIG. 5 is a sectional view taken along the line 5—5 of FIG. 3.

In the use of the preferred form of the invention shown in FIGS. 1 to 5, the spoon 12 may be moved to a retracted position prior to insertion into the container 10 or may be inserted into contact with the bottom wall 13 and retracted as an incident to turning the closure 11 onto the container, the spoon being extended a short distance beyond its fully retracted position when it engages the bottom wall as shown in FIG. 1 thereby leaving a small space between the upper end of the spoon and the lower end of the bearing sleeve 25 as shown in FIGS. 1 and 3.

To dispense the container contents, the closure 11 is removed and the spoon 12 is moved to an extended position by applying a downward force to the lug 23. When the spoon has been moved to an extended position spaced from the closure end wall a distance greater than the depth of the container, it may be moved into contact with substantially all parts of the interior of the container including the intersection between the bottom and side walls so as to remove the entire contents conveniently.

In the modified construction of FIGS. 6 and 7, the telescoping parts 21' and 22' are reversed with the lower part telescoping within the upper part which is in the form of a tube secured to and projecting rigidly from a boss 24' on the closure 11' along the closure axis. The sleeve 25' is secured to the upper end portion of the lower part and engages a shoulder 26' on the lower end of the upper part to limit outward movement of the lower part to the extended position of the brush 12' shown in FIG. 7. When in such position, the brush may be moved into contact with substantially all parts of the interior of the container to insure easy removal of the entire contents of the container.

It is obvious that many changes and modifications may be made in the closure and container of the invention without departing from the spirit and scope as defined in the following claims.

What is claimed is:

1. In combination with a hollow container having a top with an opening therein and an interior bottom wall spaced a predetermined distance from the top, a plastic closure having an end wall and adapted to be secured removably in a closed position in which said end wall engages said top, said closure being removable from said closed position to permit contents of the container to be dispensed, said closure having a flat planar top end wall, a dispensing member for the powdered contents of said container, telescoping means mounting said dispensing member on said closure for movement between a retracted position spaced from said end wall a distance no greater than said predetermined distance when the closure is in its closed position and an extended position spaced from the end wall a distance greater than said predetermined distance to permit the dispensing member to be extended through said top container opening and engage said bottom wall after the closure has been removed from the container, an integral depending boss formed on the underside of said cap and projecting toward said container, said telescoping mounting means being entirely within said container when in a retracted position, said telescoping means comprising elongated telescoping rod and tubular parts, said tubular part being secured at an upper end to said boss and on the underside of said top end wall of said closure and extending perpendicularly therefrom, said rod part carrying said dispensing member at its lower end and its other end portion being in telescoping sliding engagement with the lower end portion of said tubular part, a first interengaging stop surface on the lower end of a bearing sleeve, said bearing sleeve being on the upper end of said rod and in sliding engagement with said tubular part and having a length substantially less than the length of said rod part, an intwined shoulder on the lower end of said tubular part defining a second interengaging stop surface for engaging said first stop surface for limiting movement of said rod part and said dispensing member thereon and at said extended position of the member and to prevent separation of said rod and tubular parts from each other.

* * * * *